United States Patent [19]

Sack

[11] 3,991,967

[45] Nov. 16, 1976

[54] BOOK HOLDER

[76] Inventor: Harry Sack, 2201 Massachusetts Ave., NW., Washington, D.C. 20008

[22] Filed: May 10, 1976

[21] Appl. No.: 684,937

[52] U.S. Cl. ..... 248/448; 248/453; 248/456

[51] Int. Cl.[2] ..... A47B 97/04

[58] Field of Search ..... 248/453, 455, 456, 460, 248/461, 448, 449

[56] References Cited

UNITED STATES PATENTS

| | | | |
|---|---|---|---|
| 324,397 | 8/1885 | McClure | 248/453 |
| 565,897 | 8/1896 | Henderson | 248/453 |
| 1,203,659 | 11/1916 | Smith | 248/456 |
| 2,014,176 | 9/1935 | Henderson | 248/456 |
| 2,062,553 | 12/1936 | Campos | 248/456 X |
| 3,076,285 | 2/1963 | Sparkman | 248/448 |

*Primary Examiner*—William H. Schultz
*Attorney, Agent, or Firm*—Emory L. Groff, Jr.

[57] ABSTRACT

A book holder is erectable from a totally flat storage position to an elevated use position providing an inclined table having a shelf pivotally attached thereto. A slide assembly disposed upon the outer edge of the shelf includes a pair of pivotally mounted fingers independently laterally displaceable to allow selective positioning of the fingers upon the margins of an open book disposed upon the table and supported against the shelf. Manually releasable means are included to permit adjustment of the inclination of the table and position of the shelf relative the table.

11 Claims, 4 Drawing Figures

BOOK HOLDER

This invention relates generally to an accessory for facilitating reading, and more particularly, to a book holder or reading stand.

Numerous devices have been produced in the past to permit reading material to be retained in an open position at a desired inclination without the necessity of having the reader hold the material. The advantages of such a device are well known to those skilled in the art, yet many of the existing devices fall far short of offering the ideal arrangement. Preferably a book holder should be capable of accommodating publication of various dimensions without the necessity of the operator having to add on attachments or substitute components of the holder when changing from a publication of one size to that of another size. Notwithstanding the acceptability of publications of various dimensions, it is most important that regardless of the size of publication being utilized, it is imperative that appropriate hold-down means be provided for engagement with both pages of an open publication. A defect present in many book holders having separate means for retaining book pages of an open publication is that the page hold-down means lacks adequate adjustability for accommodating open publications of various dimensions and/or is incapable of properly retaining both opened pages without at least partially blocking the text or printed material contained on the opened pages.

By the present invention an improved book holder is provided comprising three principal components, namely, a base member, a table pivotally attached to the base and a shelf member adjustably attached to the table. Unique means are included for the adjustable attachment of the shelf to the table and the shelf itself includes a lateral slide assembly having a pair of movable fingers independently adjustable both arcuately and laterally for engagement with the margins of both pages of an opened publication disposed upon the table and supported against the shelf. The components are inter-connected to one another and by means of a simple manipulation may be collapsed from an elevated use position to an extremely compact and flat storage position.

Accordingly, one of the primary objects of the present invention is to provide an improved book holder including an inclined table having a shelf pivotally and adjustably attached thereto, which shelf includes a pair of independently laterally and angularly displaceable page engaging fingers thereon.

Another object of the present invention is to provide an improved book holder including a plurality of components pivotally attached to one another and readily displaceable from an elevated use position to a flat storage position wherein all of the components are collapsed to provide a substantially planar assembly of minimum thickness.

Still another object of the present invention is to provide an improved book holder including a table pivotally attached to a base member and adjustably positioned with respect thereto by means of a brace and including a shelf member pivotally and adjustably attached to the table and containing a pair of pivotally mounted and laterally adjustable page engaging fingers thereon.

With these and other objects in view which will more readily appear as the nature of the invention is better understood, the invention consists in the novel construction, combination and arrangement of parts hereinafter more fully described, illustrated and claimed.

A preferred and practical embodiment of the invention is shown in the accompanying drawings in which.

Similar reference characters designate corresponding parts throughout the several figures of the drawings.

Figure 1:
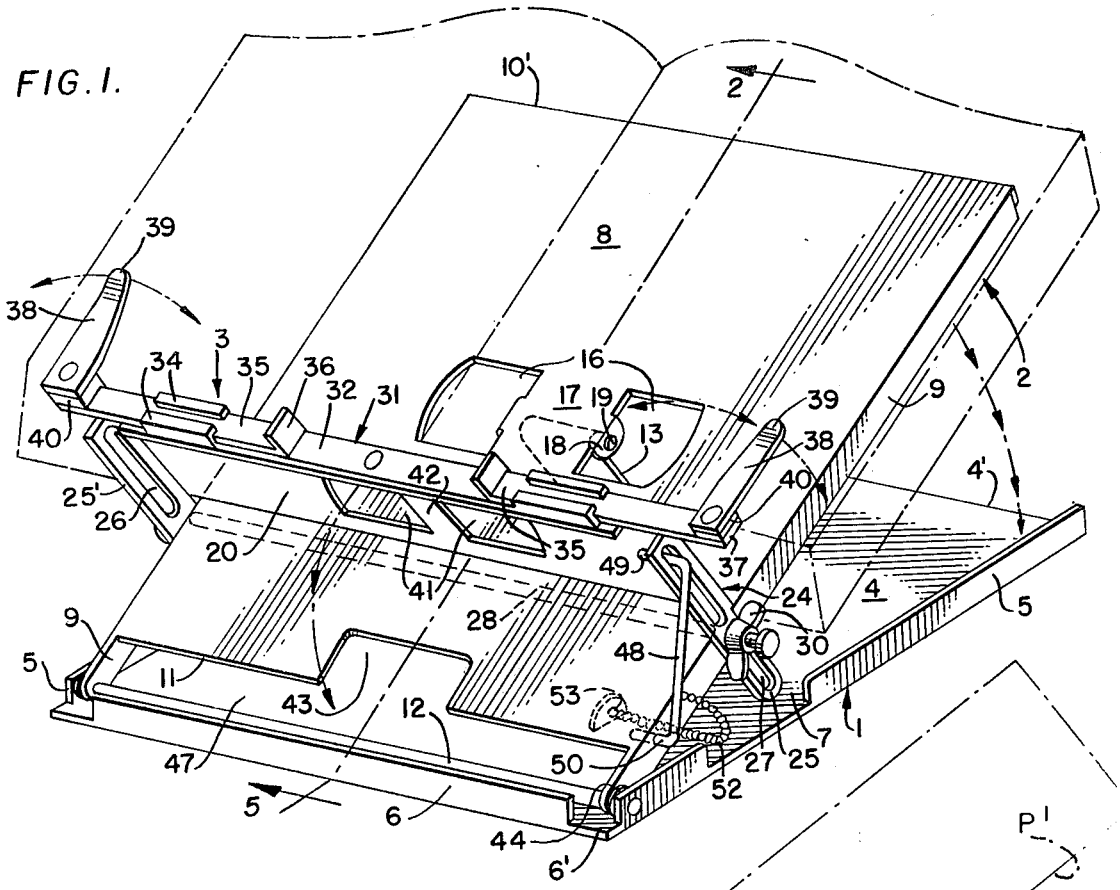
FIG. 1 is a front perspective view of the book holder of the present invention as it appears when in the use position.
Figure 2:
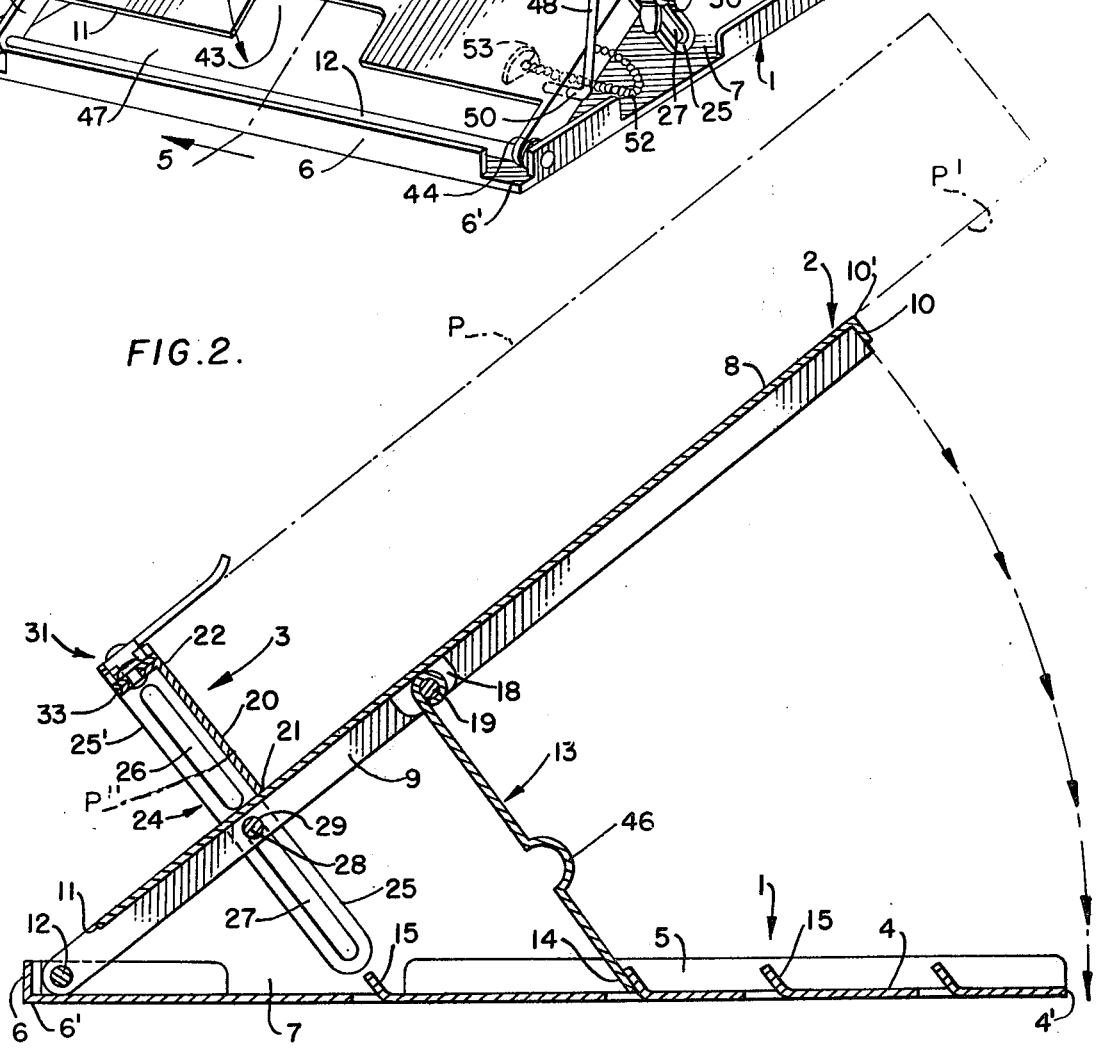
FIG. 2 is a longitudinal sectional view taken along the line 2—2 of FIG. 1.

Referring now to the drawings, particularly FIGS. 1 and 2, the book holder of the present invention will be seen to comprise a plurality of inter-connected components constructed of any suitable sheet material such as metal or plastic. The principal components include a base member 1, table 2 and shelf member 3. The base 1 includes a main body portion defining the planar surface 4 having a rear edge 40′ and is intended to be disposed upon any suitable supporting surface such as a table, desk, counter top or bed table when the book holder is being used. Each of the lateral edges of the base surface 4 are provided with upstanding side flanges 5—5 while the front edge 6′ of the surface 4 includes an upright front flange 6. A notch 7 is provided in each side flange 5 for reasons which will become obvious hereinafter.

Cooperating with the base 1 is the table 2 which includes a planar supporting surface 8 having a lateral dimension slightly less than that of the base planar surface 4 and including a side flange 9 depending from each lateral edge and extending longitudinally from a rear edge 10′ and flange 10 at the top of the table to a point substantially beyond the table supporting surface front edge 11. The afore-described base and table are pivotally connected to one another by suitable pivot means such as the pin 12 extending across the width of the book holder and passing through each of the adjacent table side flanges 9—9 and base side flanges 5—5, as shown most clearly in FIG. 1 of the drawings.

The table 2 is adapted to be supported in any of various degrees of inclination relative its attached base 1 by means of a brace 13 carried by the table 2 and having a foot portion 14 engageable behind any one of a plurality of upstanding stops 15 on the surface 4 of the base 1. These stops 15 are conveniently spaced from one another along the longitudinal extent of the medial portion of the base 1 and may comprise struck-up portions of the material forming the planar surface 4 as shown most clearly in FIG. 2 of the drawings. Each of the stops 15 is preferably inclined towards the base front flange 6 such that when engaging the brace foot portion 14 a substantially co-planar relationship exists. Quite obviously the lateral width of the stops 15 should be less than the width of the foot portion 14 of the brace 13 such that the foot portion will not enter into the opening formed by the struck-up stop 15 and mar any surface therebeneath.

The planar supporting surface 8 of the table 2 is provided with grasping means facilitating the elevation of the table 2 and the operation of the brace 13 and comprises a pair of cut-out areas 16—16 as shown in FIG. 1 of the drawings. The aforementioned brace 13 is preferably secured to the table 2 in the area of the web 17 between the two cut-outs 16 and for this purpose a pair of tabs 18 extending downwardly from the lateral edges of the web 17 serve to receive the hinge pin 19 to which is pivotally attached the upper end of the brace 13. In this manner it will be seen that ready means are provided to enable the user to both elevate and lower the table 2 merely by grasping the web 17 with two or more fingers and at the same time the user may engage the lateral edges of a brace 13 through the two openings provided by the cut-out 16 in order to angularly position the brace to allow engagement with a selected one of the stops 15 as provided on the base 1.

It is intended that the supporting surface 8 of the table 2 provides support for the back P′ of an open publication P disposed thereupon. Quite obviously, suitable means must be provided to engage the front edge P″ of such a publication P, and this latter support is provided by means of the shelf member 3. This shelf includes a planar platform 20 extending laterally the width of the table 2 and having an inner edge 21 and outer edge 22. Depending at right angles from each of the side edges 23 of the shelf platform 20 is a side flange or bracket generally designated 24, the longitudinal extent of which is substantially greater than that of the bracket upper portion 25′ adjacent the platform 20 such that a lower portion 25 is provided which will be seen to extend well beyond the shelf inner edge 21 as viewed in FIG. 2 of the drawings.

A longitudinally extending slot 26 is formed in each side bracket upper portion 25′ adjacent the shelf platform 20, while another longitudinally extending slot 27 is formed in each lower portion 25 of the bracket 24.

The above described shelf 3 is affixed to the table 2 by means of a pivot rod 28 extending transversely beneath the table supporting surface 8, through a pair of openings 29 in the side flanges 9 thereof and thence through the slot 27 provided in the two bracket lower portions 25—25. The projecting ends of the shelf pivot rod 28 are fabricated so as to accommodate an appropriate releasable fastener such as the wing nuts 30 as shown most clearly in FIG. 1 of the drawing whereby it will now be apparent that upon the loosening and retightening of wing nuts 30—30 the angular relationship of the shelf 3 to the table 2 may be varied, as may also the distance of the inner edge 21 thereof with respect to the table supporting surface 8. The former adjustment comprises a pivotal adjustment of the shelf 3 about the shelf pivot rod 28 while the latter adjustment is accomplished by lifting or lowering the shelf 3 relative the table 2 by sliding the slot 27 of the brackets 24 about the shelf pivot rod 28. In the case of the structure as illustrated in FIG. 2 it will be understood that the shelf 3 is positioned perpendicular to the adjacent table supporting surface 8 and is lowered to its maximum extent such that the inner edge 21 thereof abuts the supporting surface 8.

Figure 4:
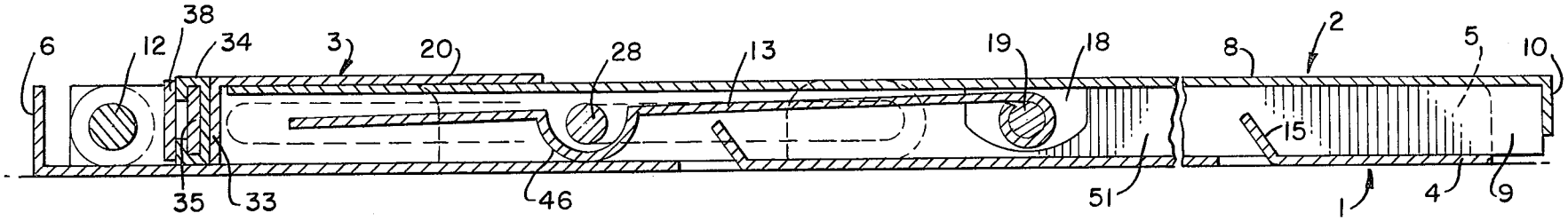
FIG. 4 is a longitudinal sectional view taken along the line 4—4 of FIG. 3.
Figure 3:
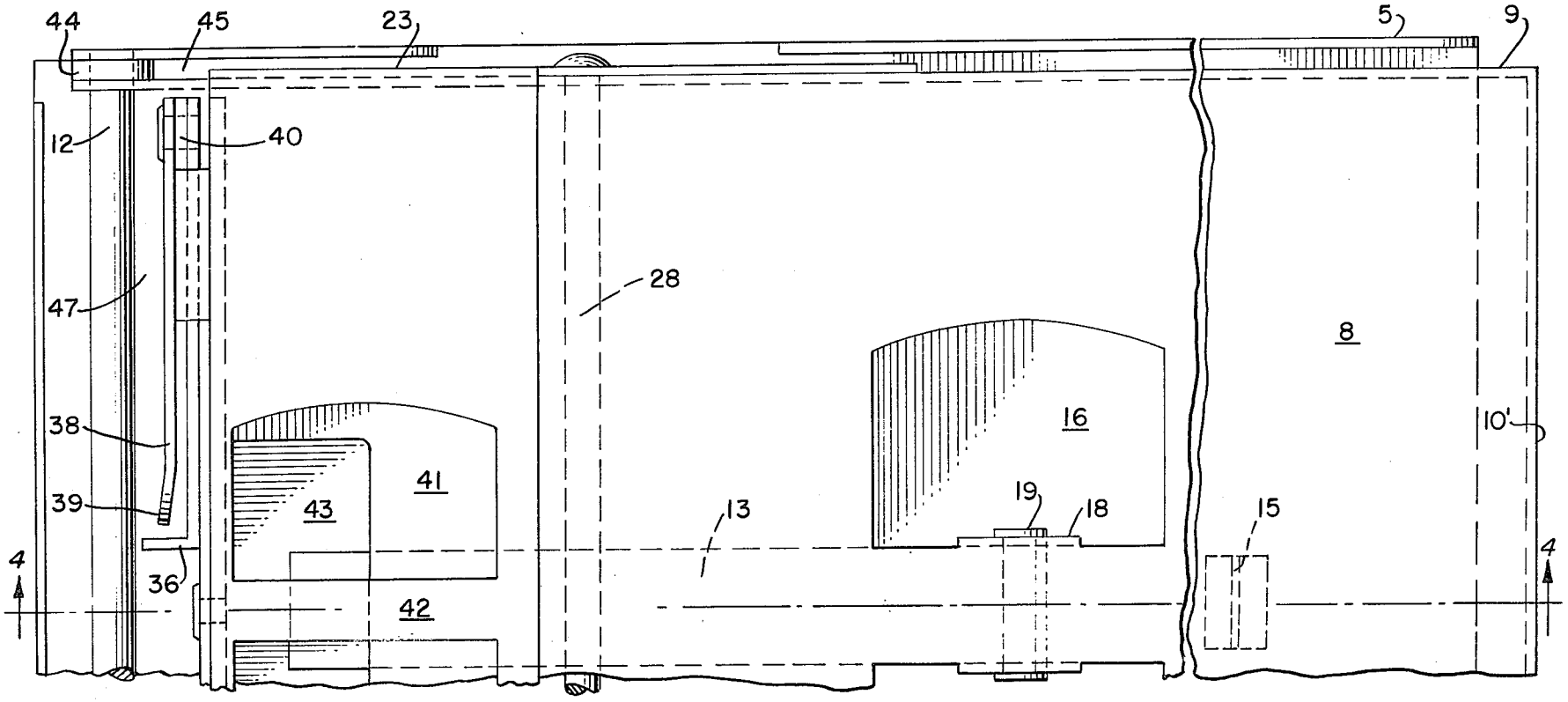
FIG. 3 is an enlarged fragmentary top plan view illustrating the book holder in the collapsed or storage position.

With the back P′ of a publication P disposed upon the table supporting surface 8 and the front edge P″ thereof resting upon the shelf platform 20, it will now be appropriate to describe the novel page holding means included in the shelf 3. This means comprises a lateral slide assembly, generally designated 31, including a slide base 32 co-extensive with and permanently affixed by any suitable means to the outer flange 33 depending from the outer edge 22 of the shelf platform 20. Each end of the slide base 32, to either side of the medial portion thereof, is provided with a pair of upstanding channel flanges 34—34 within which is fitted a slidably disposed slide member 35 having an upstanding finger tab 36 at its inner end. Attached to the upper surface of the free end 37 of each slide member 35 is the page holding means comprising a movable finger 38 having an upwardly bent distal portion 39. An appropriate spacer 40 is disposed intermediate the pivot end of the finger and the upper surface of the slide member 35 such that when the fingers are angularly displaced from the use position as shown in FIGS. 1 and 2 to the storage position as shown in FIGS. 3 and 4, the distal portion 39 of each of the fingers will clear the tops of the channel flanges 34 when the fingers are parallel to the adjacent slide members 35.

Means for facilitating grasping of the shelf 3 when it is desired to displace the same from the storage position to the use position are provided in the form of cut-outs 41—41 in the medial portion of the shelf platform 20, which cut-outs are disposed on either side of the central web 42 therein as shown most clearly in FIG. 1 of the drawings. An appropriate cut-out 43 is additionally provided in the medial portion of the front edge 11 of the table supporting surface 8 to provide clearance for the user's fingers when the web 42 of the shelf is grasped to displace the shelf from its storage position as shown in FIG. 3 of the drawings.

With the foregoing structure in mind the operation of the various components of the present invention may now be described. When the book holder is in the storage position of FIGS. 3 and 4 all of the components will be seen to be collapsed to provide a thin planar arrangement of minimum thicknesss. In this position the table 2 is disposed fully within the confines of the base 1, it being noted that the table side flanges 9 next within the upstanding side flanges 5 of the base and these table side flanges 9 are retained in a slightly inwardly spaced relationship from the juxtaposed side flanges 5 of the base by means of the spacers 44 carried by the ends of the table pivot pin 12 intermediate the two opposed flanges. Thus, a definite space 45 is at all times ensured between the nested flanges of the base and table as will be seen in FIG. 3 of the drawings and it is this space 45 which serves to receive the side flanges or brackets 24—24 of the shelf 3 when the book holder is in the folded or collapsed storage position, while the notches 7 in the base side flanges 5 serve to accommodate the wing nuts 30.

when the table 2 is lowered to the storage position the brace 13 is pivoted rearwardly so that its foot portion 14 will be disposed beneath the shelf 3. The brace 13 is provided with an offset 46 as shown in FIGS. 2 and 4 of the drawings such that when the brace is pivoted rearwardly during collapse of the components, the offset portion 46 passes around the shelf pivot rod 28.

The purpose of providing the front edge 11 of the table supporting surface 8 disposed well beyond the table pivot pin 12 will now be obvious as this construction provides for the transverse space 47 between the edge 11 and pin 12 and into which the entire lateral slide assembly 31 fits when the shelf is lowered into the collapsed storage position, as shown most clearly in FIGS. 3 and 4 of the drawings.

The function of the slot 26 provided in the shelf bracket upper portion 25′ may now be described. A keeper member 48 (FIG. 1) is provided to offer additional support to the shelf 3 and preferably includes a U-shaped member having a first end portion 49 slidably disposed within the bracket slot 26 and a second end portion 50 journalled within the table side flange 9. When the book holder is to be collapsed into the storage position the keeper member 48 is merely removed and stored within the cavity 51 formed between the nested table and base, and to preclude shifting and loss of the keeper member a retainer element 52, such as the illustrated flexible chain, may be attached to the keeper element and an appropriate tab 53 on the base, respectively.

The extraordinary compactness of the book holder is enhanced by the fact that the page holding fingers engage the pages adjacent their bottom edges, instead of adjacent the side edges as in many prior devices. This feature, coupled with the fact that the page holding mechanism can be moved laterally well beyond the side limits of the table when in use yet is returned to a position within the confines of the table when not in use, leads to a device having a very high degree of collapsibility. The resultant easy and convenient manual transportability of such a compact device is of primary importance to students, for example, who carry their books to school and from classroom to classroom and from building to building.

I claim:

1. A book holder including, a base member adapted to be disposed upon a support surface and having side flanges and front and rear edges, a table overlying said base member and having side flanges and front and rear edges, means pivotally connecting said table to said base member adjacent said respective front edge, said table including a substantially planar supporting surface adapted to engage the back of an open publication, a brace intermediate said table and base member adjustable to selectively position and retain said table supporting surface at variable inclinations relative said base member, a shelf member provided with a platform disposed atop said table and adapted to support the front edge of a publication disposed upon said table, said platform including side brackets overlying said table side flanges and each having an elongated slot therein, releasable fastener means disposed through said bracket slots and table side flanges to pivotally and slidably connect said shelf member to said table, a slide assembly carried by said shelf member, said slide assembly including a pair of laterally displaceable slide members each having an outer free end and a page holding finger pivotally attached to each slide member adjacent said free end whereby, publications of various thicknesses and widths may be accommodated by manipulating said fastener means to allow raising or lowering of said shelf member relative said table and said slide members may be independently laterally positioned to allow selective pivoting of said fingers to engage the margins of the open publication therebeneath.

2. A book holder according to claim 1 wherein, said brace is pivotally attached to said table, a plurality of stops projecting upwardly from said base member and a foot portion on said brace engageable with a selected one of said stops.

3. A book holder according to claim 1 wherein, said shelf platform includes inner and outer edges and said slide assembly angularly depends from said platform and is parallel thereto.

4. A book holder according to claim 1 wherein, said slide members each include an upright tab adjacent its end opposite said free end.

5. A book holder according to claim 1 wherein, said table supporting surface is provided with a pair of spaced apart finger-engaging cut-out portions.

6. A book holder according to claim 1 wherein, said shelf platform is provided with a pair of spaced apart finger-engaging cut-out portions.

7. A book holder according to claim 1 wherein, said table side flanges are disposed inwardly of said base side flanges and means on said table and base connecting means maintaining a definite space between said table and base side flanges whereby when said table is collapsed to a position nested within said base said shelf brackets are freely disposed within said defined space.

8. A book holder according to claim 1 wherein, said table front edge is substantially spaced from said base front edge to define a transverse space therebetween bounded by said base and table side flanges whereby, when said table is collapsed to a position parallel with said base said shelf brackets may be pivoted about said releasable fastener means to position said slide assembly within said transverse space.

9. A book holder according to claim 1 including, a front flange extending upwardly from said base member front edge and a rear flange projecting downwardly from said table rear edge whereby upon collapsing of said table and base member about said connecting means to provide a compact parallel assembly, said side flanges, table, rear flange and base member front flange combine to enclose a cavity between said collapsed table and base member.

10. A book holder according to claim 2 wherein, said base member includes a sustantially planar surface and said stops comprise portions struck up from said planar surface, and said brace foot portion is of a greater width than said struck-up portions.

11. A book holder according to claim 5 including, a web disposed between said cut-up portions, the said brace is pivotally attached to said table supporting surface beneath said web.

* * * * *